US011585245B2

(12) United States Patent
Öhman et al.

(10) Patent No.: US 11,585,245 B2
(45) Date of Patent: Feb. 21, 2023

(54) POWER GENERATION SYSTEM AND METHOD TO GENERATE POWER BY OPERATION OF SUCH POWER GENERATION SYSTEM

(71) Applicant: ATLAS COPCO AIRPOWER, NAAMLOZE VENNOOTSCHAP, Wilrijk (BE)

(72) Inventors: Henrik Öhman, Taby (SE); Anton Jan Goethals, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 17/600,424

(22) PCT Filed: Feb. 11, 2020

(86) PCT No.: PCT/IB2020/051081
§ 371 (c)(1),
(2) Date: Sep. 30, 2021

(87) PCT Pub. No.: WO2020/201843
PCT Pub. Date: Oct. 8, 2020

(65) Prior Publication Data

US 2022/0186636 A1 Jun. 16, 2022

Related U.S. Application Data

(60) Provisional application No. 62/829,738, filed on Apr. 5, 2019.

(30) Foreign Application Priority Data

May 7, 2019 (BE) ..... 2019/5300

(51) Int. Cl.
*F01K 25/08* (2006.01)
*F01D 25/08* (2006.01)
(Continued)

(52) U.S. Cl.
CPC ..... *F01K 25/08* (2013.01); *F01D 25/08* (2013.01); *F01D 25/12* (2013.01); *F01K 13/025* (2013.01)

(58) Field of Classification Search
CPC ..... F01K 25/08; F01K 13/025; F01D 25/08; F01D 25/12
(Continued)

(56) References Cited

U.S. PATENT DOCUMENTS 2,410,457 A * 11/1946 Nettel ..... F02C 1/10 62/332
7,069,726 B2 * 7/2006 Frutschi ..... F01K 21/04 60/39.181
(Continued)

FOREIGN PATENT DOCUMENTS

FR 3 004 487 A1 10/2014
WO 2016/205188 A1 12/2016
(Continued)

OTHER PUBLICATIONS

International Search Report for PCT/IB2020/051081 dated Jun. 4, 2020 [PCT/ISA/210].
(Continued)

*Primary Examiner* — Hoang M Nguyen
(74) *Attorney, Agent, or Firm* — Sughrue Mion, PLLC

(57) ABSTRACT

A power generation system comprising
- a liquid pump section (4) comprising a rotary liquid pump (7) with an impeller in which a working fluid is pressurised and which is driven by a drive shaft (8);
- an evaporator section comprising an evaporator (9) in which the in the rotary liquid pump (7) pressurised working fluid is at least partly evaporated by addition of heat from a heat source;
- an expander section (3) comprising a rotary expander (11) with an inlet port (16) and a rotary expander element in which the in the evaporator section at least partly evaporated working fluid is expanded; and
- a generator section (5) comprising a rotary power generator (13) with a rotor, whereby the expander section (3), the liquid pump section (4) and the generator section (5) are rotably connected in such a manner that relative rotational speed ratios between the rotary expander element of the rotary expander (11), the impeller of the rotary liquid pump (7) and the rotor of the rotary power generator (13) are mechanically upheld, char-
(Continued)

Figure 1B:
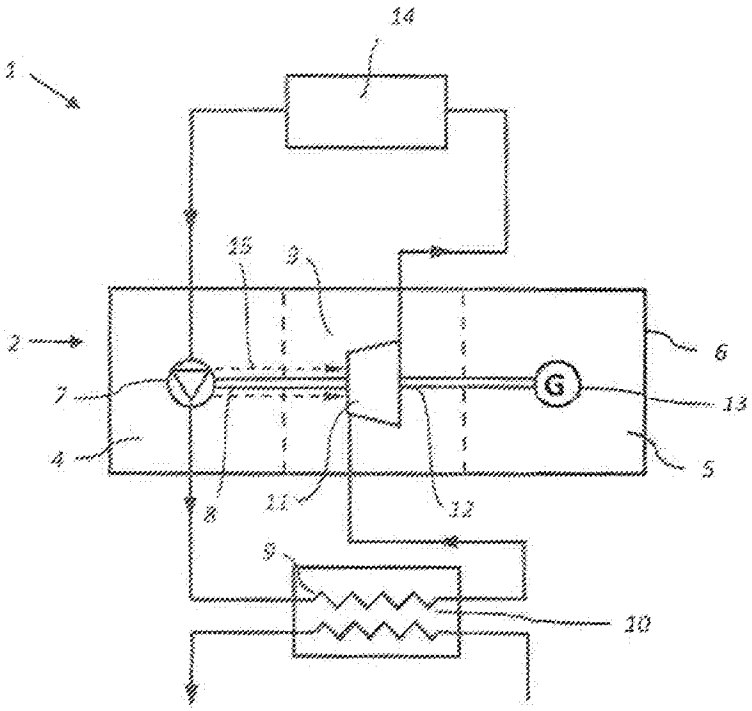

acterised in that the drive shaft (8) which drives the impeller of the rotary liquid pump (7), is configured to be provided with a throttling device allowing a controlled portion (15) of the working fluid entering the rotary liquid pump (7) to pass from the liquid pump section (4) to the expander section (3) and/or the generator section (5).

26 Claims, 3 Drawing Sheets

(51) Int. Cl.
*F01D 25/12* (2006.01)
*F01K 13/02* (2006.01)

(58) Field of Classification Search
USPC ..... 60/646, 657
See application file for complete search history.

(56) References Cited

U.S. PATENT DOCUMENTS

2004/0020206 A1* 2/2004 Sullivan ..... F01C 11/00 60/670
2011/0296849 A1* 12/2011 Benson ..... F25B 7/00 62/434
2014/0102098 A1* 4/2014 Bowan ..... F01K 7/32 60/671
2017/0241297 A1 8/2017 Graczyk

FOREIGN PATENT DOCUMENTS

WO 2016/207289 A2 12/2016
WO 2017/027480 A1 2/2017

OTHER PUBLICATIONS

Written Opinion for PCT/IB2020/051081 dated Jun. 4, 2020 [PCT/ISA/237].

* cited by examiner

POWER GENERATION SYSTEM AND METHOD TO GENERATE POWER BY OPERATION OF SUCH POWER GENERATION SYSTEM

CROSS REFERENCE TO RELATED APPLICATIONS

This application is a National Stage of International Application No. PCT/IB2020/051081 filed Feb. 11, 2020, claiming priority based on U.S. Patent Application No. 62/829,738 filed Apr. 5, 2019 and Belgium Patent Application No. 2019/5300 filed May 7, 2019.

The present invention concerns a power generation system comprising an expander section expanding a working fluid, a liquid pump section pressurising this working fluid, and a generator section, whereby the expander section, the liquid pump section and the generator section are rotably connected in such a manner that the relative rotational speed ratios between the expander section, the liquid medium section and the generator section are mechanically upheld.

In particular, the power generation system further comprises a semi-hermetically closed housing which encloses all rotating parts of the expander section, liquid pump section and the generator section, but the power generation system is not restricted thereto.

It is known that power is generated in expansion machines by converting the energy associated with the pressure of a working fluid into mechanical kinetic energy of an expander which is a turbine or similar with a rotor, a piston, or similar. This kinetic energy can be further converted into electric energy in a rotary power generator with a rotor which is rotably connected to the expansion machine by means of a shaft, coupling, gear, belt, or similar. The expansion machine can be driven by a working fluid which is circulated in a closed circuit that is known by the name Rankine cycle or Rankine circuit. This closed circuit is provided with a liquid pump to circulate the working fluid successively through

- an evaporator section comprising one or more evaporators in which the working fluid coming from the liquid pump is at least partly converted into high pressure gas or vapour;
- the expander section;
- a condenser section comprising one or more condensers that are connected to a cooling circuit of a coolant, for example water or air, to enable the complete condensation of the working fluid into liquid that is pumped around again by the liquid pump for a subsequent cycle.

To close the Rankine cycle, an outlet of the liquid pump section is fluidly connected to an inlet of the evaporator section, an outlet of the evaporator section is fluidly connected to an inlet of the expander section, an outlet of the expander section is fluidly connected to an inlet of the condenser section, and an outlet of the condenser is fluidly connected to an inlet of the liquid pump section.

The working fluid may be selected as an organic working fluid, whereby the Rankine cycle is known by the name Organic Rankine Cycle or ORC. A disadvantage of organic working fluids is that they are typically either explosive, poisonous, or expensive. Therefore, mechanical shaft seals are required where rotating parts of a rotary expander and/or rotary power generator penetrate through the housing containing the working fluid around the rotor of the expander respectively the generator and are in contact with ambient air. Such mechanical shaft seals are expensive and typically require extensive maintenance.

A common way to avoid the use of mechanical shaft seals between the working fluid and the ambient air is to design compact 'semi-hermetic' or 'integrated' combinations of the expander and the generator. By 'semi-hermetic' or 'integrated' combinations of an expander and a generator is meant a combination of an expander and a generator contained in a housing in which all rotating parts of the expander and generator are fully enclosed by the housing and therefore isolated from contact with the ambient air. Examples of semi-hermetic or integrated combinations of an expander and a generator are described among others in U.S. Pat. No. 4,185,465 and DE 10 2012 016 488. EP 0004609 shows a semi-hermetic combination of a screw expander, a screw compressor and an electric motor in a refrigerant working fluid. JP H 05195808 and CN 206290297 show integrated combinations of an expander, a generator and a liquid pump.

A disadvantage of integrated combinations of an expander, a generator and a liquid pump is the occurrence of unwanted internal leakages of the working fluid inside the housing between the expander section containing the expander, the generator section containing the generator and the liquid pump section containing the liquid pump, due to the existence of significantly different pressure levels of the working fluid in these sections of the housing. Such internal leakages do not only reduce the efficiency of the power generation, but also the reliability of the power generation system due to violent flashing when the working fluid is in a mixed liquid-gas or mixed liquid-vapour state. Additionally, cavitation occurs in the liquid pump when high pressure vapour of the working fluid leaks from the expander section or the generator section to the liquid pump. Furthermore, large amounts of liquid may leak from the liquid pump via the drive shaft of the liquid pump to the condenser without passing through the evaporator, resulting in a reduction of power generation efficiency, whereby 'power generation efficiency' is defined as the ratio of the mechanical energy generated in the expander section over the sum of the heat transferred to the working fluid in the evaporator section and the work delivered to the liquid pump. Alternatively, tight seals on the drive shaft of the liquid pump to avoid leakage from the liquid pump via its drive shaft are prone to wear and require undesired maintenance.

Furthermore, if the generator is a permanent magnet generator, the magnets of this permanent magnet generator may suffer from insufficient cooling due to the compact size of the integrated combination of the expander, the generator and the liquid pump, resulting in permanent damage to performance.

EP 2 386 727 discloses a power generation system designed as a Rankine cycle comprising a turboexpander including an integrated combination of an expander section, a liquid pump section and a motor-generator section, whereby the motor-generator section is cooled by a portion of the working fluid which is pressurised by the liquid pump section. The disadvantage of this system design is that the generator is internally exposed to the high working fluid pressure at the outlet of the liquid pump section, which might cause permanent damage to the rotor and other internal parts of the generator.

WO 82/02741 discloses a Rankine cycle turbine generator system with an integrated combination of an expander section, a liquid pump section and a generator section on a single vertical shaft in a hermetically sealed case, whereby a portion of the working fluid coming from the condenser is pumped by a booster pump upstream of the liquid pump section to the bearings of the shaft for lubrication and cooling purposes. The cooling of the generator is accomplished by leakage of working fluid from the top bearing assembly and a liquid pump in the liquid pump section. The disadvantage of this system is the need of the booster pump, in addition to the liquid pump, to pressurise the portion of the working fluid that is used to lubricate and cool the bearings, in order to avoid the evaporation of said portion of working fluid and the production of vapour in the bearing cavities due to the addition of small amounts of heat which would impair the proper functioning of the fluid as a hydrodynamic lubricant in the bearings. Additionally, the rotor and other internal parts of the generator are again exposed to the high working fluid pressure in the bearing cavities and at the outlet of the liquid pump section.

The purpose of the present invention is to provide a solution to one or more of the aforementioned and/or other disadvantages.

To this end, the invention concerns a power generation system comprising

- a liquid pump section comprising a rotary liquid pump with an impeller in which a working fluid is pressurised and which is driven by a drive shaft;
- an evaporator section comprising an evaporator in which the in the rotary liquid pump pressurised working fluid is at least partly evaporated by addition of heat from a heat source;
- an expander section comprising a rotary expander with an inlet port and a rotary expander element in which the in the evaporator section at least partly evaporated working fluid is expanded; and
- a generator section comprising a rotary power generator with a rotor, whereby the expander section, the liquid pump section and the generator section are rotably connected in such a manner that the relative rotational speed ratios between the rotary expander element of the rotary expander, the impeller of the rotary liquid pump and the rotor of the rotary power generator are mechanically upheld, with the characteristic that the drive shaft which drives the impeller of the rotary liquid pump, is configured to be provided with a throttling device allowing a controlled portion of the working fluid entering the rotary liquid pump to pass from the liquid pump section to the expander section and/or the generator section.

An advantage of the power generation system according to the invention if the controlled portion of working fluid passes from the liquid pump section to the generator section, is the possibility of connecting the rotary liquid pump of the liquid pump section directly to the rotor of the rotary power generator, while avoiding cavitation of the rotary liquid pump due to leakage of working fluid vapour into the rotary liquid pump, and avoiding losses in power generation efficiency due to large amounts of working fluid flowing directly from the rotary liquid pump to the rotary power generator without passing through the evaporator. The small controlled portion of working fluid allowed by the throttle device which passes from the liquid pump section to the generator section, is just enough to keep the rotary power generator cooled to a suitable level, mainly by local evaporation. The rotary power generator is hereby exposed to a working fluid pressure lower than the working fluid pressure at an outlet of the liquid pump section, preventing damage to the rotor or other internal parts of the rotary power generator due to working fluid pressure which are too high.

An advantage of the power generation system according to the invention if the controlled portion of working fluid passes from the liquid pump section to the expander section, is the possibility of connecting the rotary liquid pump of the liquid pump section directly to the rotor of the rotary expander, while avoiding cavitation of the rotary liquid pump due to leakage of working fluid vapour into the rotary liquid pump, and avoiding losses in power generation efficiency due to large amounts of working fluid flowing directly from the rotary liquid pump to the rotary expander without passing through the evaporator. The small controlled portion of working fluid allowed by the throttle device which passes from the liquid pump section to the expander section, is just enough to keep bearings and other rotating parts of the rotary expander cooled to a suitable level, mainly by local evaporation.

A further advantage is that, if the rotary power generator is a permanent magnet generator and if the controlled portion of the working fluid allowed by the throttling device is passing from the liquid pump section to the generator section, this controlled portion of working fluid can be used to cool the magnets of the rotary power generator.

In a preferred embodiment of the invention, the power generation system is arranged as a Rankine circuit, preferably an ORC circuit with an organic working fluid.

In another preferred embodiment of the invention, the inlet port of the rotary expander of the expander section is in a higher position than an outlet port of said rotary expander. Furthermore, the rotary liquid pump is in a lower position than the inlet port of the rotary expander.

This brings the advantage of allowing expanded working fluid in a mixed liquid-vapour phase to exit the rotary expander without pumping losses caused by internal ascension of mixed phase working fluid.

The invention may be used for an integrated combination of one single expander section, one single liquid pump section, and a generator section.

However, the invention may also be used for an integrated combination of two or more expander sections, two or more liquid pump sections, and a generator section. Each of the expander or liquid pump sections can comprise several rotary expanders respectively rotary liquid pumps.

The invention also relates to a method to generate power by operation of a power generation system, the power generation system comprising:

- a liquid pump section comprising an inlet and a rotary liquid pump with an impeller in which a working fluid is pressurised and which is driven by a drive shaft;
- an evaporator section comprising an evaporator in which the in the rotary liquid pump pressurised working fluid is at least partly evaporated by addition of heat from a heat source;
- an expander section comprising a rotary expander with a rotary expander element in which the in the evaporator section at least partly evaporated working fluid is expanded; and
- a generator section comprising a rotary power generator with a rotor, whereby the expander section, the liquid pump section and the generator section are rotably connected in such a manner that relative rotational speed ratios between the rotary expander element of the rotary expander, the impeller of the rotary liquid pump and the rotor of the rotary power generator are mechanically upheld, with the characteristic that a controlled portion of the working fluid entering the rotary liquid pump is allowed to pass from the liquid pump section to the expander section and/or the generator section by means of a throttling device, which the drive shaft by which the impeller of the rotary liquid pump is driven is provided with, whereby the rotary expander and/or rotary power generator is cooled by the controlled portion of the working fluid which passes from the liquid pump section to the expander section respectively the generator section.

In a preferred embodiment of the invention, a mass flow of the controlled portion of working fluid that is allowed to pass from the liquid pump section to the expander section and/or the generator section by the throttling device is lower than 25%, preferably lower than 10%, more preferably lower than 5%, even more preferably lower than 3% of a total mass flow of the working fluid which is fed to the inlet of the liquid pump section. In this way, the controlled portion of working fluid is just enough to keep the rotor and other components of the rotary power generator respectively bearings and other rotating parts of the rotary expander cooled to a suitable level, mainly by local evaporation.

Figure 1A:
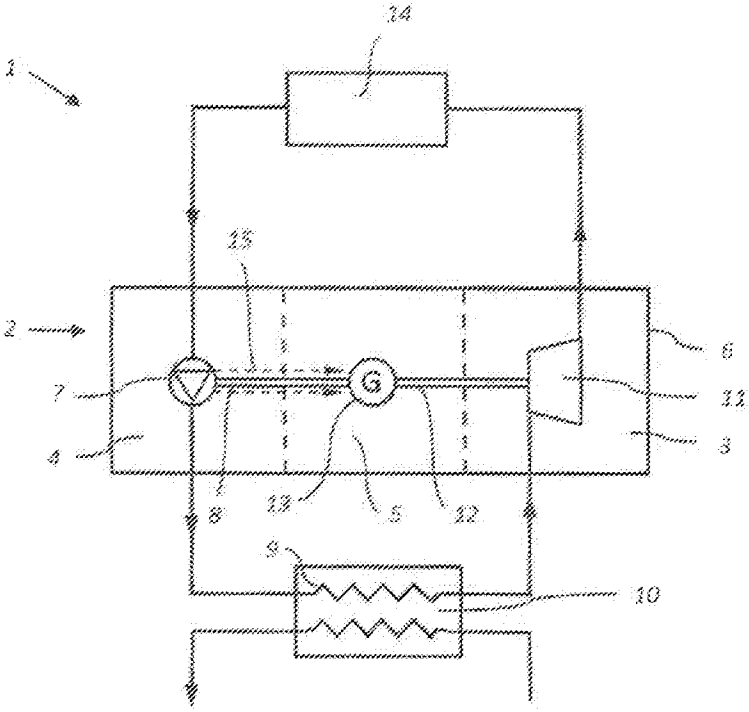
Figure 6:
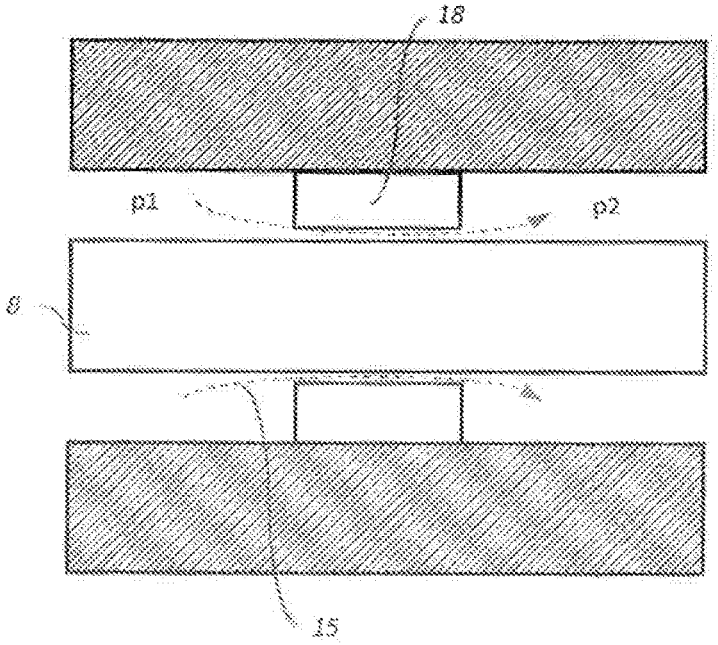

With the intention of better showing the characteristics of the invention, a few preferred embodiments of a power generation system according to the invention whereby the drive shaft of the rotary liquid pump is provided with a throttling device, are described hereinafter by way of example, without any limiting nature, with reference to the accompanying drawings, wherein:

FIGS. 1A and 1B schematically show a Rankine circuit including a power generation system according to the invention;

FIGS. 2 to 5 each show a different variant of the power generation system;

FIG. 6 shows in more detail a sealing of a drive shaft of a rotary liquid pump of the power generation system.

In this case, the power generation system 1 in FIG. 1A is a Rankine circuit comprising an integrated combination 2 of an expander section 3, a liquid pump section 4, and a generator section 5

Preferably all rotating parts of the expander section 3 and the generator section 5, and preferably also the liquid pump section 4 are enclosed in a semi-hermetically closed housing 6.

A rotary liquid pump 7 in the liquid pump section 4 drives the working fluid through the circuit by means of a rotating impeller that is driven by a drive shaft 8 of the rotary liquid pump 7. The rotary liquid pump 7 may be a positive displacement rotary pump, preferably a gear pump.

Flow of the working fluid through the circuit is as follows.

The rotary liquid pump 7 drives the working fluid in liquid form through an evaporator section comprising an evaporator 9 which is a first section of a heat exchanger 10. A heating medium providing heat from a heat source flows through a second section of the heat exchanger 10, preferably countercurrently with respect to the working fluid flowing through the evaporator 9.

The heat source may be waste heat from a process installation such as a compressor installation, such that the power generation system 1 is a so-called WTP (Waste heat To Power) installation transforming recovered waste heat into useful mechanical or electrical energy.

The working fluid evaporates at least partly in the evaporator 9 due to heat transfer from the heating medium to the working fluid, and leaves the evaporator 9 in a gaseous or vapour state or as a mixture of liquid and gas or vapour.

The working fluid is typically characterised by a more favourable evaporation characteristic, which is the boiling temperature at the working fluid pressure in the evaporator 9, with respect to the temperature of a heating medium which provides heat to the working fluid in the evaporator 9.

The lower the boiling temperature of the working fluid in the evaporator 9, the better and more efficient heat is provided to the working fluid by a heating medium at low temperature. Typically, a working fluid is selected whose critical point temperature is close to a maximum temperature of the heating medium in the heat exchanger 10.

Furthermore, the working fluid may comprise a lubricant or act as a lubricant for components of the power generation system 1.

An example of a suitable organic working fluid is 1,1,1,3,3-pentafluoropropane. However, the invention is not limited to this specific working fluid.

The at least partly evaporated working fluid leaving the evaporator 9 is expanded in a rotary expander 11 in the expander section 3. The rotary expander 11 is configured such that it enables thermal energy of the working fluid to be converted into mechanical energy, for example because it is constructed in the form of a rotary expander element which is driven by an outgoing drive shaft 12 that is coupled to a rotor of a rotary power generator 13 in the generator section 5 for supplying electrical energy to a consumer.

The rotary expander 11 in the expander section 3 may be a positive displacement rotary expander, preferably a twin-screw rotary expander.

The rotary power generator 13 in the generator section 5 may be a synchronous generator, preferably a permanent magnet generator.

The expanded working fluid leaving the expander section 3 flows through a condenser section comprising a condenser 14 where it comes into contact with and is cooled by a cooling medium, which ensures that the working fluid completely condenses in order to be able to be pumped around as a liquid by the rotary liquid pump 7 for a subsequent cycle in the Rankine circuit.

A controlled portion 15 of the working fluid entering the rotary liquid pump 7 is allowed to leak from the liquid pump section 4 to the generator section 5 via a throttling device which is provided on the drive shaft 8 which drives the impeller of the rotary liquid pump 7. This controlled portion of the working fluid 15 will pass over and through the rotary power generator 13. In this way, the rotor and other components of the rotary power generator 13 are cooled to a suitable extent.

As indicated in FIG. 1B, the position of the expander section 3 and the generator section 5 may be interchanged in the housing 6, such that the controlled portion 15 of the working fluid is leaking to the expander section 3 via the throttling device provided on the drive shaft 8 of the rotary liquid pump 7. The controlled portion 15 of the working fluid is then used to cool bearings and other components of the rotary expander 11.

It is not excluded that in FIGS. 1A and/or 1B the controlled portion 15 of the working fluid flows through both the expander section 3 and the generator section 5, and is used to cool both components of the rotary expander 11 and components of the generator 13.

The expander section 3, the liquid pump section 4 and the generator section 5 are rotably connected in such a manner that relative rotational speed ratios between the rotary expander element of the rotary expander 11, the impeller of the rotary liquid pump 7 and the rotor of the rotary power generator 13 are mechanically upheld.

This can be achieved by connecting the rotary expander element of the rotary expander 11, the impeller of the rotary liquid pump 7, the rotor of the rotary power generator 13, the drive shaft 8 of the rotary liquid pump 7, and the drive shaft 12 of the rotary power generator 13 by means of gearboxes. However, the rotary expander element of the rotary expander 11 and/or the impeller of the rotary liquid pump 7 may be mounted directly on the drive shaft 8. Similarly, the rotary expander element of the rotary expander 11 and/or the rotor of the rotary power generator 13 may be mounted directly on the drive shaft 12.

In a variant of the invention, the rotary expander element 11 is mounted on the drive shaft 8 which drives the impeller of the rotary liquid pump 7. Furthermore, the rotary expander element of the rotary expander 11 may be mounted on the drive shaft 12 which drives the rotor of the rotary power generator 13.

The drive shaft 8 which drives the impeller of the rotary liquid pump 7 may be different from the drive shaft 12 which drives the rotor of the rotary power generator 13, for example when the impeller of the rotary liquid pump 7 is driven by a drive shaft 8 connected to a male rotor element of the rotary expander 11 and the rotor of the rotary power generator 13 is driven by a drive shaft 12 connected to a female rotor element of the rotary expander 11 or vice versa. Alternatively, the rotor of the rotary power generator 13 may be driven be the same drive shaft as the impeller of the rotary liquid pump 7, such that drive shafts 8 and 12 become one and the same drive shaft.

Different configurations are possible for the positioning and orientation of the expander section 3, the liquid pump section 4 and the generator section 5 in the semi-hermetically closed housing 6, as indicated in FIGS. 2 to 5.

Figure 2:
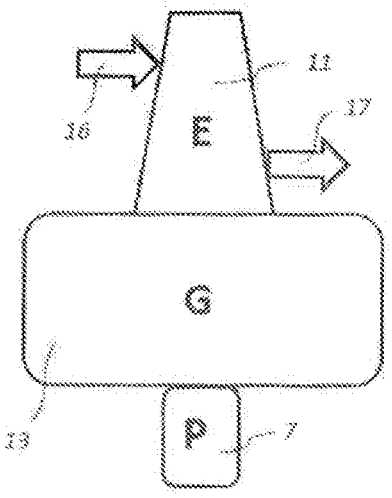

FIG. 2 schematically shows a combination of an expander section 3, a generator section 5 and a liquid pump section 4, whereby these sections are vertically mounted and rotably connected in such a manner that the relative rotational speed ratios between the rotary expander element of the rotary expander 11, the impeller of the rotary liquid pump 7 and the rotor of the rotary power generator 13 are mechanically upheld. The controlled portion 15 of the working fluid flows from the liquid pump section 4 to the generator section 5 in order to cool the rotor and other internal components of the rotary power generator 15. The rotary expander 11 of the expander section 3 is provided with an inlet port 16 which is in a higher position than the outlet port 17 of this rotary expander 11. The rotary liquid pump 7 of the liquid pump section 4 is in a lower position than the inlet port 16 of the rotary expander 11 to avoid cavitation of the rotary liquid pump 7 and the resulting pumping losses due to internal ascension of mixed phase working fluid and backflow of gaseous or vaporous working fluid from the rotary expander 11 to the rotary liquid pump 7.

Figure 3:
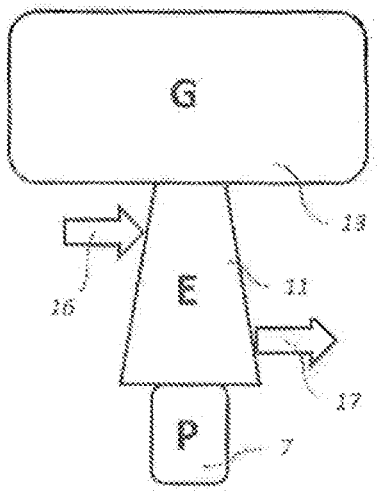

FIG. 3 shows a variant of the combination in FIG. 2, whereby the positions of the expander section 3 and the generator section 5 are interchanged, such that the controlled portion 15 of the working fluid allowed by the throttling device which is provided on the drive shaft 8 of the rotary liquid pump 7, flows from the liquid pump section 4 to the expander section 3 in order to cool the bearings and other rotating parts of the rotary expander 11.

Figure 4:
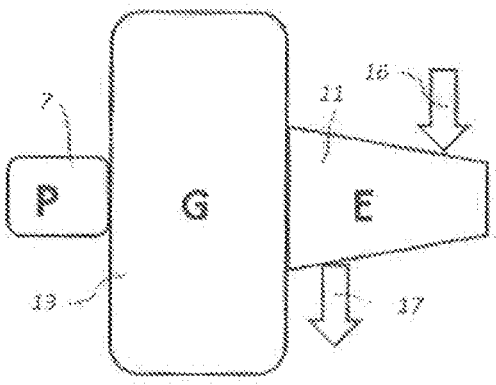

FIG. 4 shows a variant of the combination in FIG. 2, whereby the expander section 3, the generator section 5 and the liquid pump section 4 are horizontally mounted.

Figure 5:
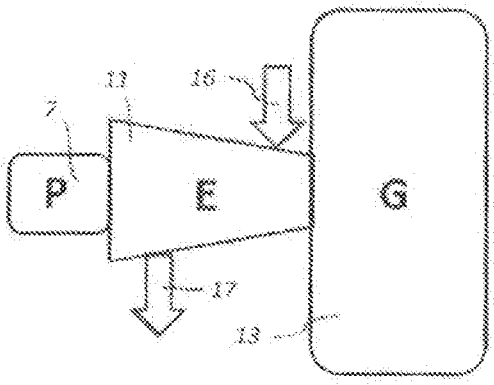

FIG. 5 shows a variant of the combination of an expander section 3, a generator section 5 and a liquid pump section 4 in FIG. 4, whereby the positions of the expander section 3 and the generator section 5 are interchanged.

In FIG. 6 is demonstrated that the controlled portion 15 of the working fluid is throttled and leaking via the drive shaft 8 of the rotary liquid pump 7 from the liquid pump section 4 at a pressure level p1 to one of the expander section 3 and generator section 5 at a pressure level p2 which is lower than p1. In this case, the throttling device is an opening between the drive shaft 8 on which the impeller of the rotary liquid pump 7 is mounted and a sealing 18 of this drive shaft 8 between the liquid pump section 4 and the one of the expander section 3 and generator section 5.

The controlled portion 15 of the working fluid which is allowed to pass from the liquid pump section 4 to the expander section 3 or the generator section 5 by the throttling device, which the drive shaft 8 which drives the impeller of the rotary liquid pump 7 is provided with, may be used to cool the rotary expander 11 or the rotary power generator 13 in a method to generate power by operation of the power generation system 1 according to the invention.

In this method, the inlet port 16 of the rotary expander 11 in the expander section 3 is fed with at least partly evaporated working fluid coming from the evaporator 9 in the evaporator section.

The rotor of the rotary power generator 13 is cooled by and exposed to working fluid at a pressure level which is higher than a working fluid pressure level at an inlet of the liquid pump section 4 and lower than a working fluid pressure level at an outlet of the liquid pump section 4. As the temperature of the working fluid which is cooling the rotary power generator 13 increases during its cooling action, this working fluid may evaporate such that the rotor of the rotary power generator 13 is exposed to a mixture of liquid and gaseous or vaporous working fluid.

The mass flow of the controlled portion 15 of the working fluid is only a small portion relative to the total mass flow of the working fluid which is fed to the inlet of the liquid pump section 4, preferably lower than 25%, more preferably lower than 10%, even more preferably lower than 5%, yet more preferably lower than 3%.

The present invention is by no means limited to the embodiments described as an example and shown in the drawings, but a power generation system and a method to generate power by operation of such power generation system according to the invention can be realised in all kinds of forms or dimensions without departing from the scope of the invention, and by extension is also applicable to a power generation system with more than one expander section or liquid pump section or a power generation system comprising an expander section with more than one rotary expander or a liquid pump section with more than one rotary liquid pump.

The invention claimed is:

1. A power generation system comprising a liquid pump section (4) comprising a rotary liquid pump (7) with an impeller in which a working fluid is pressurised and which is driven by a drive shaft (8);

an evaporator section comprising an evaporator (9) in which the in the rotary liquid pump (7) pressurised working fluid is at least partly evaporated by addition of heat from a heat source;

an expander section (3) comprising a rotary expander (11) with an inlet port (16) and a rotary expander element in which the in the evaporator section at least partly evaporated working fluid is expanded; and a generator section (5) comprising a rotary power generator (13) with a rotor, whereby the expander section (3), the liquid pump section (4) and the generator section (5) are rotably connected in such a manner that relative rotational speed ratios between the rotary expander element of the rotary expander (11), the impeller of the rotary liquid pump (7) and the rotor of the rotary power generator (13) are mechanically upheld, wherein the drive shaft (8) which drives the impeller of the rotary liquid pump (7), is configured to be provided with a throttling device allowing a controlled portion (15) of the working fluid entering the rotary liquid pump (7) to pass from the liquid pump section (4) to the expander section (3) and/or the generator section (5).

2. The power generation system according to claim 1, wherein the power generation system (1) is a Rankine cycle, wherein the working fluid circulates.

3. The power generation system according to claim 1, wherein the inlet port (16) of the rotary expander (11) is in a higher position than an outlet port (17) of said rotary expander.

4. The power generation system according to claim 1, wherein the rotary liquid pump (7) is in a lower position than the inlet port (16) of the rotary expander (11).

5. The power generation system according to claim 1, wherein the rotary power generator (13) in the generator section (5) is a synchronous generator.

6. The power generation system according to claim 1, wherein the working fluid is an organic working fluid.

7. The power generation system according to claim 1, wherein the working fluid comprises a lubricant or acts as a lubricant.

8. The power generation system according to claim 1, wherein the rotary expander element is mounted on the drive shaft (8) which drives the impeller of the rotary liquid pump (7).

9. The power generation system according to claim 1, wherein the rotary expander element is mounted on a drive shaft (12) which drives the rotor of the rotary power generator (13).

10. The power generation system according to claim 1, wherein the drive shaft (8) which drives the impeller of the rotary liquid pump (7), is different from the drive shaft (12) which drives the rotor of the rotary power generator (13).

11. The power generation system according to claim 1, wherein the rotor of the rotary power generator (13) is driven by the drive shaft (8) which drives the impeller of the rotary liquid pump (7).

12. The power generation system according to claim 1, wherein the power generation system (1) further comprises a semi-hermetically closed housing (6) which encloses all rotating parts of the rotary expander (11) and the rotary power generator (13).

13. The power generation system according to claim 12, wherein the semi-hermetically closed housing (6) encloses all rotating parts of the rotary liquid pump (7).

14. The power generation system according to claim 13, wherein the position of the expander section (3) in the semi-hermetically closed housing (6) is in between the liquid pump section (4) and the generator section (5).

15. The power generation system according to claim 13, wherein the position of the generator section (5) in the semi-hermetically closed housing (6) is in between the liquid pump section (4) and the expander section (3).

16. The power generation system according to claim 1, wherein the rotary expander (11) is a positive displacement rotary expander.

17. The power generation system according to claim 1, wherein the rotary liquid pump (7) is a positive displacement rotary pump.

18. The power generation system according to claim 1, wherein the rotary expander (11) and/or the rotary power generator (13) are mounted in a vertical position.

19. The power generation system according to claim 1, wherein the rotary expander (11) and/or the rotary power generator (13) are mounted in a horizontal position.

20. The power generation system according to claim 1, wherein the throttling device is an opening between the drive shaft (8) on which the impeller of the rotary liquid pump (7) is mounted and a sealing (18) of this drive shaft (8) between the liquid pump section (4) and one of the expander section (3) and generator section (5).

21. A method to generate power by operation of a power generation system (1), the power generation system (1) comprising:

a liquid pump section (4) comprising an inlet and a rotary liquid pump (7) with an impeller in which a working fluid is pressurised and which is driven by a drive shaft (8);

an evaporator section comprising an evaporator (9) in which the in the rotary liquid pump (7) pressurised working fluid is at least partly evaporated by addition of heat from a heat source;

an expander section (3) comprising a rotary expander (11) with a rotary expander element in which the in the evaporator section at least partly evaporated working fluid is expanded; and a generator section (5) comprising a rotary power generator (13) with a rotor, whereby the expander section (3), the liquid pump section (4) and the generator section (5) are rotably connected in such a manner that relative rotational speed ratios between the rotary expander element of the rotary expander (11), the impeller of the rotary liquid pump (7) and the rotor of the rotary power generator (13) are mechanically upheld, wherein a controlled portion (15) of the working fluid entering the rotary liquid pump (7) is allowed to pass from the liquid pump section (4) to the expander section (3) and/or the generator section (5) by means of a throttling device, which the drive shaft (8) by which the impeller of the rotary liquid pump (7) is driven is provided with, whereby the rotary expander (11) and/or rotary power generator (13) is cooled by the controlled portion (15) of the working fluid which passes from the liquid pump section (4) to the expander section (3) respectively the generator section (5).

22. A method to generate power according to claim 21, wherein the at least partly evaporated working fluid which is fed to an inlet port (16) of the rotary expander is in a gaseous or vapour state.

23. A method to generate power according to claim 21, wherein the working fluid which is fed to an inlet port (16) of the rotary expander (11) is a mixture of liquid and gaseous or vaporous working fluid.

24. A method to generate power according to claim 21, wherein the rotor of the rotary power generator (13) is exposed to a pressure exerted by the working fluid which is higher than a working fluid pressure at the inlet of the liquid pump section (4) and lower than a working fluid pressure at an outlet of the liquid pump section (4).

25. A method to generate power according to claim 21, wherein the rotor of the rotary power generator (13) is exposed to a mixture of liquid and gaseous or vaporous working fluid.

26. A method to generate power according to claim 21, wherein a mass flow of the controlled portion (15) of working fluid which is allowed to pass from the liquid pump section (4) to the expander section (3) and/or the generator section (5) by a throttling device, is lower than 25% of a total mass flow of the working fluid which is fed to the inlet of the liquid pump section (4).

* * * * *